United States Patent [19]

Gueret

[11] Patent Number: 4,681,127

[45] Date of Patent: Jul. 21, 1987

[54] RIGID MAKE UP COMPACT WITH A FLEXIBLE INNER SHELL FRAME

[75] Inventor: Jean-Louis H. Gueret, Paris, France

[73] Assignee: "L'Oreal", Paris, France

[21] Appl. No.: 612,724

[22] Filed: May 21, 1984

[30] Foreign Application Priority Data

May 27, 1983 [FR] France ..... 83 08806
Mar. 5, 1984 [FR] France ..... 84 03364

[51] Int. Cl.[4] ..... A45D 33/00

[52] U.S. Cl. ..... 132/82 R; 132/82 D; 132/83 R; 132/83 E

[58] Field of Search ..... 132/82 R, 82 A, 82 B, 132/82 C, 82 D, 82 F, 82 G, 83 R, 83 B, 83 C, 83 D, 83 F, 83 G, 83 H

[56] References Cited

U.S. PATENT DOCUMENTS

| | | | |
|---|---|---|---|
| 1,485,357 | 3/1924 | Aber | 132/83 E |
| 1,497,905 | 6/1924 | Hathaway | 132/82 R |
| 1,531,953 | 3/1925 | Kendall | 132/82 R |
| 1,626,413 | 4/1927 | Kendall . | |
| 1,709,182 | 4/1929 | McKnight et al. | 132/83 R |
| 1,851,462 | 3/1932 | Steller | 132/82 D |
| 1,872,864 | 8/1932 | Yarcho . | |
| 2,025,971 | 12/1935 | Callowhill . | |
| 2,230,202 | 1/1941 | Machin et al. . | |
| 2,438,841 | 3/1948 | Casalino | 132/83 R |
| 2,442,541 | 6/1948 | Fox | 132/83 R |
| 3,342,190 | 9/1967 | Hultgren et al. . | |
| 3,442,414 | 5/1969 | Pelli | 132/83 R |
| 3,911,936 | 10/1975 | Kingsford . | |

FOREIGN PATENT DOCUMENTS

| | | |
|---|---|---|
| 0002443 | 6/1979 | European Pat. Off. . |
| 2610107 | 9/1977 | Fed. Rep. of Germany . |
| 2196944 | 3/1974 | France . |
| 2411942 | 7/1979 | France . |
| 2412474 | 7/1979 | France . |
| 310618 | 5/1929 | United Kingdom . |
| 319574 | 9/1929 | United Kingdom . |
| 562662 | 7/1944 | United Kingdom . |
| 2103699 | 2/1983 | United Kingdom . |

*Primary Examiner*—John J. Wilson
*Attorney, Agent, or Firm*—Cushman, Darby & Cushman

[57] ABSTRACT

A powder compact comprises a base of relatively rigid plastics material which receives a flexible shell frame, by ultrasonic welding or catch-engagement, and the relatively rigid lid of the compact is hinged to the shell frame. Furthermore, the relatively elastic shell frame provides a convenient vehicle for carrying the resilient catch of the compact.

Additionally, opening members are provided to bias the lid towards the open position.

32 Claims, 23 Drawing Figures

RIGID MAKE UP COMPACT WITH A FLEXIBLE INNER SHELL FRAME

FIELD OF THE INVENTION

The present invention concerns casings of the make-up compact type, and more particularly such a moulded and rigid compact provided with a flexible inner shell frame.

PRIOR ART

In order to keep and present make-up products such as eye shadow or powder, the cosmetics and perfumery industries use many different types of make-up compacts containing pellets of eye shadow or of compacted powder, and possibly accessories such as applicator brushes. These compacts most frequently comprise a base provided with a bottom and a lid which are the two main elements, molded of a relatively rigid plastic material, for instance of polystyrene, and articulated to each other by a hinge with an inserted pin.

Such a design has the drawbacks of requiring an operation for the mounting of this pin and hence of increasing the time and cost of manufacture and of having an adverse effect on the appearance of the finished product by reason of the passage holes for the pin which are visible from the outside.

These compacts are, moreover, provided with a closing device or a fastener constituted by at least two members having parts of a complementary shape whereof at least one can be moved together with the respective member or on the respective member in relation to the main compact element carrying this member.

But, generally, either (a) at least one of the members of the closing device is attached to the main compact element carrying it, in which case one again finds the above mentioned drawbacks relating to the articulating hinge in the region of the fastener, that is to say, that the operation for the mounting of the attached member increases the time and cost of manufacture and that the presence of an attached member has an adverse effect on the appearance of the finished product; or (b) it constitutes an elastically deformable part of the main compact element carrying it and is obtained by moulding together with this main element, in which case, since the main element is relatively rigid, the handling of this elastically deformable member and hence the opening of the compact represent difficult operations because this member has little flexibility.

In order to facilitate the opening of the compact, it has already been proposed, in this latter case, to increase the flexibility by assigning a small thickness to this elastically deformable member or to the part of the latter connecting it to the so-called main compact element; but this solution has the drawbacks that it is then much more difficult to mould this member integrally with the corresponding main element and that the durability of such a member is very limited because it rapidly breaks in use.

In order to remedy the above mentioned various drawbacks exhibited by the designs presented above, it has already been proposed, in French Pat. No. 1,550,963, to make a compact comprising on the one hand, a base and a lid molded of a plastic material having good rigidity and, on the other hand, an intermediate part moulded of a plastic material having a certain flexibility in comparison with that used for making the base and the cover, for instance, of polypropylene, this intermediate part comprising a base frame which is elastically fitted on the base and a lid frame which is elastically fitted on the lid, the two frames being articulated to each other by an elastic film hinge obtained by moulding together with the two frames, each carrying one of the complementary members, obtained by moulding with the respective frame, of an elastic catch engagement closing device.

This design, which is simple to make and easy to assemble, is nevertheless not wholly satisfactory because the film hinge articulating the two pliable frames to each other has limited durability and does not allow a proper reproducible opening of the compact with a constant amplitude which is inconveniencing the users and, moreover, when the base and lid are rounded at the level of the film hinge, the latter has a shape adversely affecting the appearance of the compact.

OBJECT OF THE INVENTION

By the present invention, it is proposed to remedy the various drawbacks attaching to the various designs of the prior art.

SUMMARY OF THE INVENTION

Accordingly, the present invention provides a compact which is intended to enclose at least one make-up product having a solid consistency and which includes first and second hingedly connected main elements made of a relatively rigid material. One of the main elements will constitute the base and the other main element will constitute the lid of the compact. Fastener means having two members each having parts of complementary shape are provided to secure the base and the lid to each other and to keep them applied against each other in the closed position of the compact. One of these members will be movable in order to allow the manipulation of the fastener means and to effect the closing and opening of the compact. In this regard, a shell frame made of a relatively flexible material is mounted in the base of the compact with the shell frame carrying one of the members of the fastener means which is to be movable. Preferably, this member is accessible from the outside of the compact, in a closed position, by a passage arranged in the base. The manipulation of the member, so as to effect the opening of the compact is performed by deforming at least the one zone of the shell frame so as to release the member from the other member of the fastener means which is carried by said second main element of the compact.

There is, therefore, no need for said member of the fastener means thus carried by the flexible shell to be of a small thickness to allow an easy manipulation of the fastener, and its durability as well as the constancy and reproducibility of its functioning are considerably improved, whilst simultaneously its manufacture is simplified if said one member of the fastener means is molded integrally with the shell which is very favourable from the point of view of appearance.

In order to facilitate opening, the compact advantageously comprises at least one member for the opening of the compact which moves the lid away from the base when said member of the fastener means carried by the shell is manipulated.

Such an opening member can be carried by the shell, by said one member of the fastener means which is itself carried by the shell, or by the second main element of the compact.

In an advantageous embodiment, said at least one member for opening the compact is an elastic member which also locks the two members of the fastener means in their fixed position in respect to each other whilst said one member of the fastener means which is carried by the shell is maintained in the closed position of the compact.

Because of this, the opening member constitutes, in the closed position of the compact, a locking member of the fastener means.

The shell advantageously also carries one of the elements of the hinge whose other element is carried by the second main element of the compact, which makes it possible to prevent the presence of a passage for the hinge pins from being visible from the outside of the compact without the manufacture of the shell, preferably by molding, thereby becoming more complex; provision may be made for connecting the shell to the second main compact element by means of a hinge of the conventional type, the pin of the said hinge remaining hidden, thanks to the side walls of the compact base; the hinge may in particular be arranged around a pin passing through certain elements of the compact lid and of the shell; preferably, the shell carries at least one bearing for the hinge and at least one pin of the hinge is carried by the second main element of the compact, because one thus obtains a rigid hinge pin which may be easily mounted, for instance, by elastic catch engagement in a flexible bearing.

In order to facilitate the use of the compact, especially when the shell is mounted in the base of the compact whose lid may possibly carry on its internal face a small mirror which must be held steady in a given position in relation to the base when the compact is open, the opening of the lid in relation to the base may be limited to a maximum angle by the cooperation of a stop of the shell with a stop of the second main compact element which is, most frequently in this case, the lid. Preferably the base and the lid are interlocked with respect to each other in the maximum opening position of the compact by the elastic catch engagement of a first tooth which is carried by the shell or by the second main compact element between two further teeth carried respectively by the second main element of the compact or by the shell. The user may thus hold the base of the open compact in one hand without having to keep the lid in position and can use her other hand for applying make-up.

The shell can be fixed in the first main element either by elastic catch engagement or by any other suitable means, for instance by ultrasonic welding.

Preferably the shell constitutes an internal frame mounted in the base of the compact and defining with the bottom of this base at least one compartment in the compact so that the pellets of make-up or of powder and the applicator brushes can be disposed in this at least one compartment.

However, in such an arrangement there are no means of ensuring the seal of the dish-shaped compartment in the closed position of the compact when the products which they contain have to be protected against the outer atmosphere. This is particularly the case with make-up comprising solvents or volatile constituents which may therefore well evaporate and lead to a drying out of the product, thus rendering them unusable for making up.

The compact may ensure this sealing function and may for this purpose use the propensity of the shell of flexible material to deform readily, so that the application on the said shell of a bead made of a relatively rigid material carried by the second main compact element constitutes the equivalent of a gasket seal. Advantageously, the shell is channel-shaped in the zone wherein the seal must be effected, this channel accommodating the bead made of a rigid material.

Thus, in a particular embodiment of the present invention, at least one make-up product is contained in a respective dish carried by the base and/or by the shell, and the second main element cooperates with the shell to ensure the seal of the at least one dish in the closed position of the compact. Preferably, the second main element comprises internally at least one bead closed on itself which is integral with the said second main element, the said bead being capable of deforming the zone of the said shell which is situated opposite and surrounds said at least one dish when it is caused to bear on the shell as the compact is being closed. In particular, the zone of the said shell situated opposite each bead has the shape of a continuously enclosed channel whose concavity faces the associated bead. In this case, the shell advantageously comprises, opposite each bead, a thin wall having an undulation constituting the channel.

In the case where the first main compact element is the base and where the shell has an opening for the accommodation of each one of the dishes, each dish is advantageously delimited by the bottom of the base and by a lateral skirt integrally obtained with the said bottom. In the case where it comprises, opposite each bead, a thin wall having an undulation constituting the channel, the shell will then advantageously comprise a substantially flat wall which comprises at least one sealing channel and wherein there is at least one opening for the accommodation of the at least one dish, the said wall being turned back, on the one hand at its periphery, and on the other hand along the edge of each one of the above mentioned openings, with a view to fixing the shell within the base. In a particular embodiment of the compact, the free edge of the shell defining each one of the openings in the said shell, is received in a groove formed on the floor of the base, such groove being advantageously defined between, on the one hand, the skirt constituting the lateral wall of a dish and, on the other hand, a bead which is coaxial with the said skirt and is made integrally with the floor of the said base.

Moreover, it is not only possible and advantageous for the base and the lid of the compact, as well as the shell, to be components molded of plastics materials and for said one member of the fastener means carried by the shell to be integrally moulded with the latter, it is also possible and advantageous for each said opening member as well as each of the hinge elements to be obtained by molding with the molded component carrying it.

The fastener means equipping the compact may be of many different types and in particular, by way of thrust or squeezing deformation, or by means of a penetrating or pivoted push button.

In particular, in a first form, said one member of the fastener means which is carried by the shell, is an elastically deformable member with a substantially channel-shaped cross-section straddling a portion of the periphery of the first main compact element and elastically joined to the shell by its side flange accommodated within the compact and which has on its external side flange a projecting portion elastically catch-engaging behind a catch integral with the second main compact element so that an inwardly directed push on that side flange of the channel-shaped member which is outside the compact, produces a deformation of the channel-shaped member whose projecting part is released from the catch of the second main compact element. As with prior art compacts, the closing of the compact is obtained by shutting down the lid against the base, which produces the elastic catch-engagement of the catch integral with the second main element behind the projecting part of the channel-shaped member.

The projecting part of the deformable member in this case advantageously constitutes a member for the opening of the compact, which begins to open it by pushing back the second main compact element in relation to the first.

In a second form said one member of the fastener means, which is carried by the shell, is a push button engaged in an opening of the first main compact element and elastically connected to the shell and strained in a direction locking a catch of the push button behind a catch which is integral with the second main compact element so that a push exerted on the push button releases the two catches from each other and allows the compact to be opened. In that case, it is possible to mount the push button slidably substantially within the opening of the first main compact element whilst straining it elastically towards the outside of the compact by means of at least one flexible connecting strap to the shell, the release of the catches being obtained by a push directed towards the inside of the compact and tending to drive the push button into the compact. The or an opening member of the compact may then be constituted by a ramp carried by the push button and pushing back the catch which is integral with the second main compact element which is thus removed from the first when the push button is pushed back towards the inside of the compact. But it is also possible for the push button to be substantially swivel mounted in the opening of the first main compact element and for it to be elastically biased into the position locking the catches by an elastic hinge for connection to the shell, the release of the catches being obtained by a push directed transversely in relation to the compact and tending to bend the push button around the elastic hinge.

In a third form, said one member of the fastener means which is carried by the shell comprises two straps passing through an opening arranged in the first main compact element and elastically connected to the shell and each biased into a position locking a closing stud projecting on the side opposite the second main compact element so that the squeezing action exerted on the two straps and bringing them nearer each other releases the two closing studs and allows the compact to be opened.

In a fourth form, said one member of the fastener means which has at least one movable part is constituted by an external tongue connected to the shell, the said tongue being turned back to constitute a flap surmounting the free side of the said shell and capable of being fixed by elastic catch-engagement in a cavity arranged along a corresponding edge of the second main element.

In these various forms of the preferred embodiment, at least one of the members for opening the compact may be constituted by a pair of tongues, each elastically joined at one end to the shell in the portion of the latter which is near the hinge of the compact and on the side of the shell turned towards the second main compact element which is pushed back by the other end of the tongues.

Where said first main element of the compact is constituted by the base, at least one bead of the lid encircles a mirror disposed against the said lid, and this bead advantageously ensures the seal of the dish which is opposite thereto when the compact is closed.

To render the object of the invention more readily understood, there will be described below five embodiments represented in the attached drawings by way of purely illustrative and non-restrictive examples.

Figure 1:
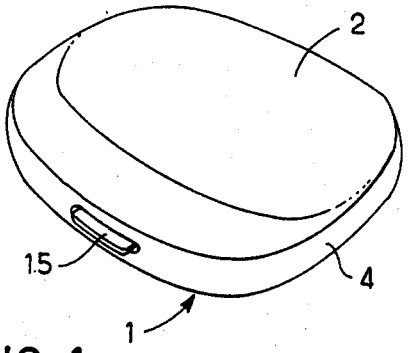
FIG. 1 is a view in perspective of a compact according to a first embodiment of the invention in the closed position.
Figure 2:
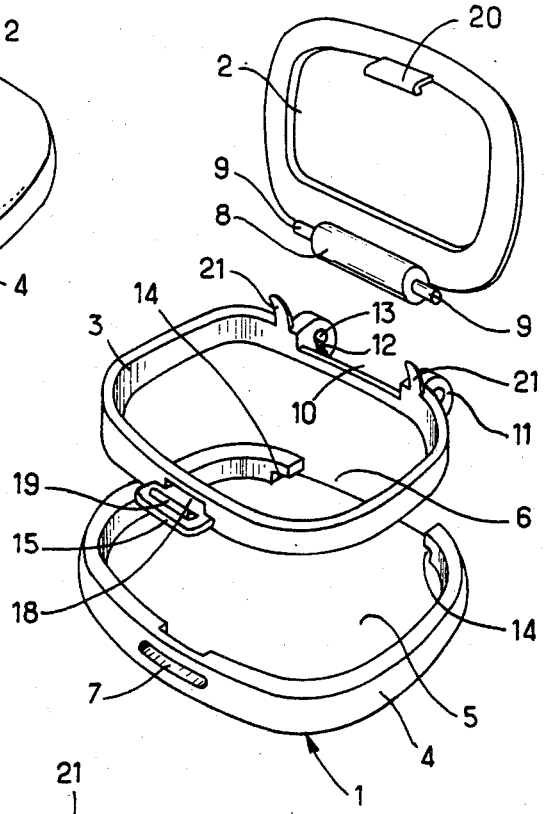
FIG. 2 is a view in an exploded perspective of the compact of FIG. 1, in the open position.
Figure 3:
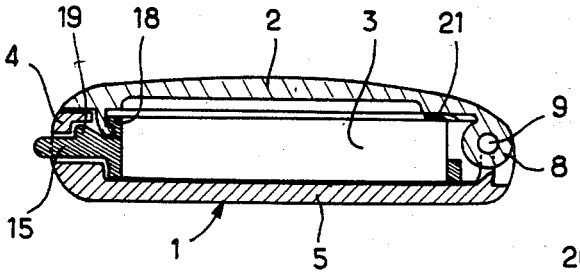
FIG. 3 is a vertical cross-sectional view of the compact of FIG. 1.
Figure 3A:
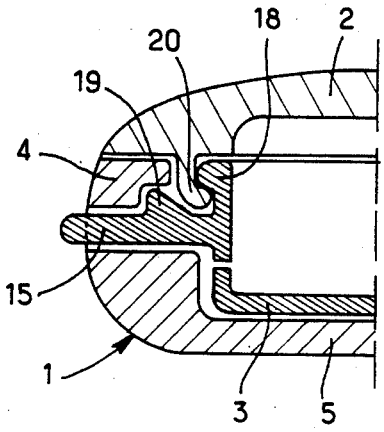
Figure 4:
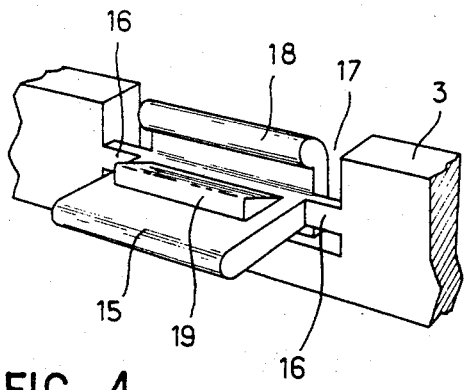
Figure 5:
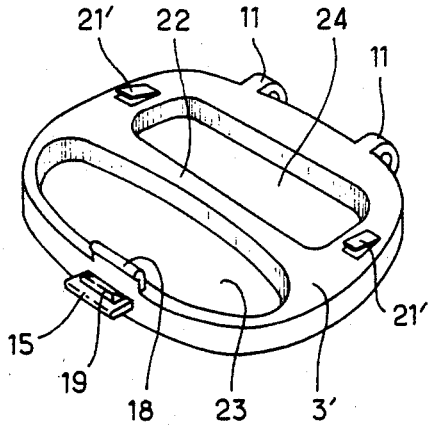
Figure 7:
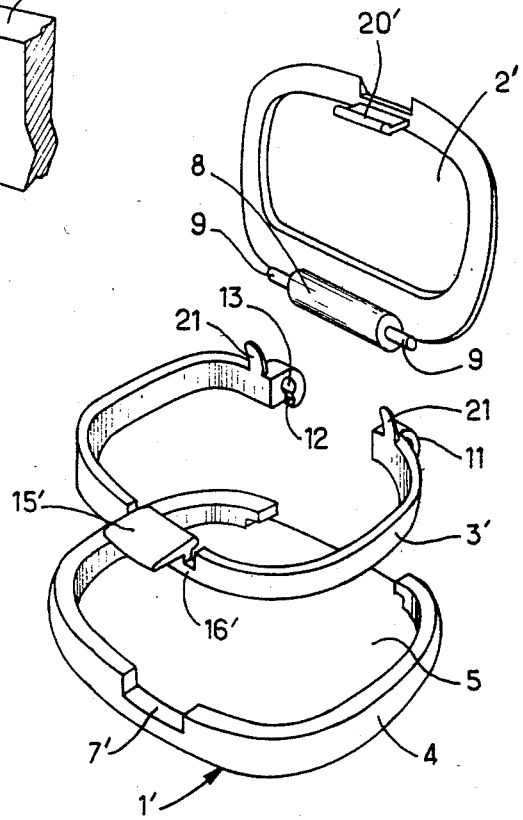
Figure 6:
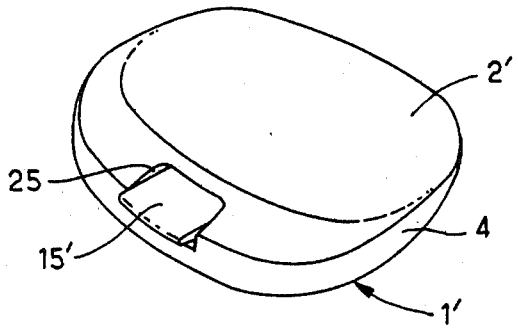
Figure 8:
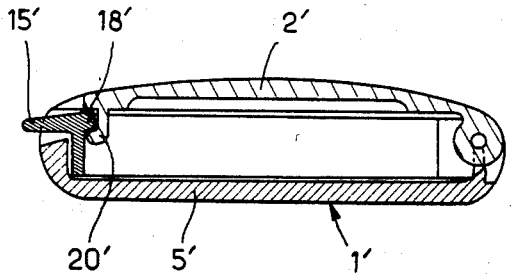
Figure 10:
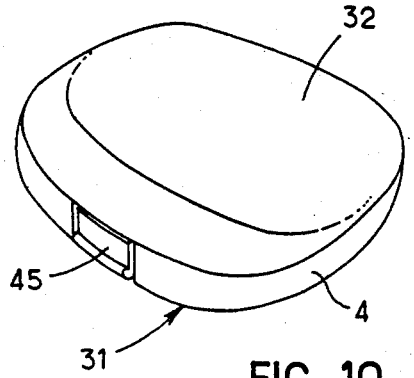
Figure 9:
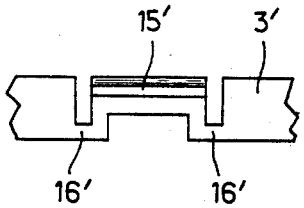
Figure 11:
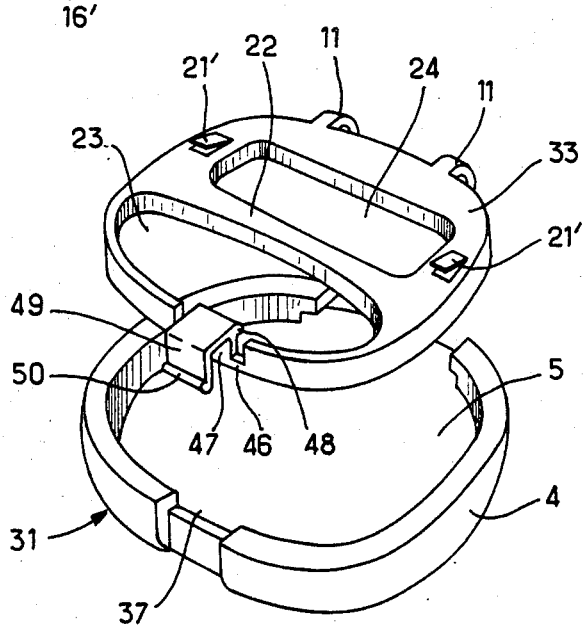
Figure 12A:
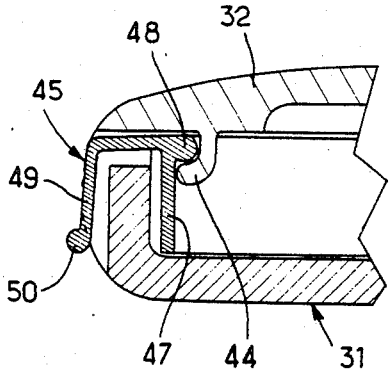
Figure 12B:
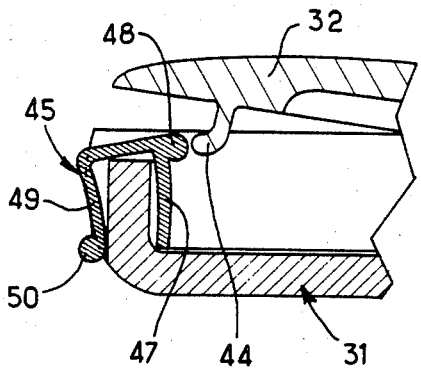
Figure 14:
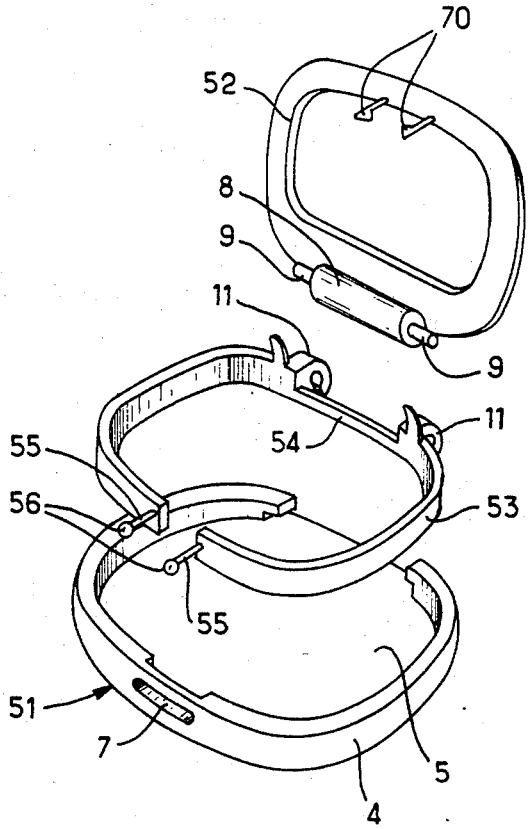
Figure 13:
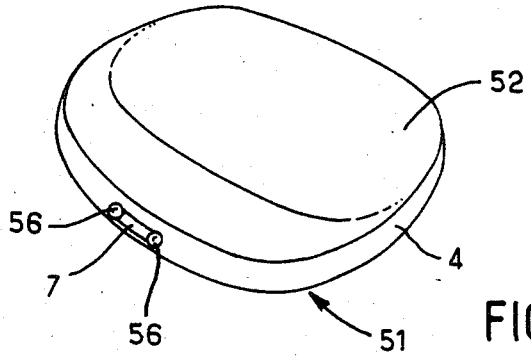
Figure 15:
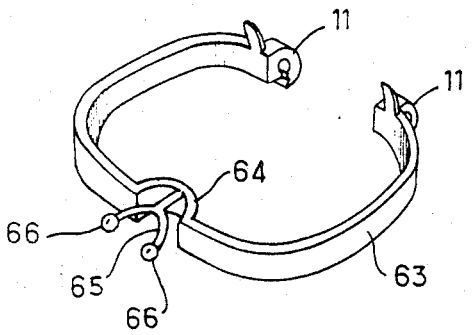
Figure 16:
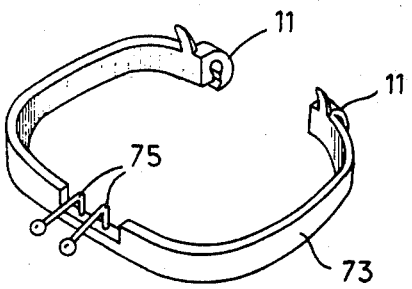
Figure 17:
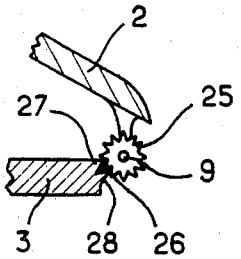
Figure 18:
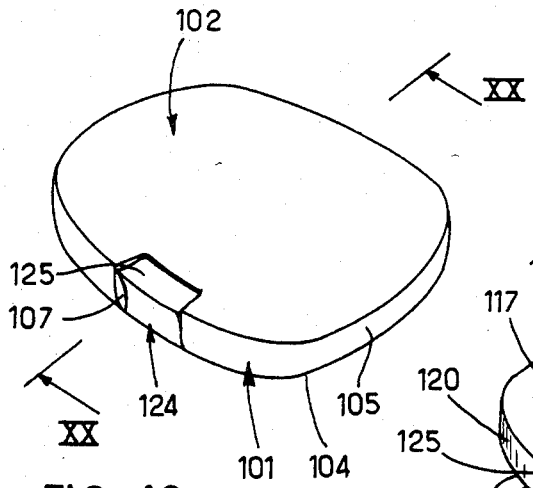
Figure 19:
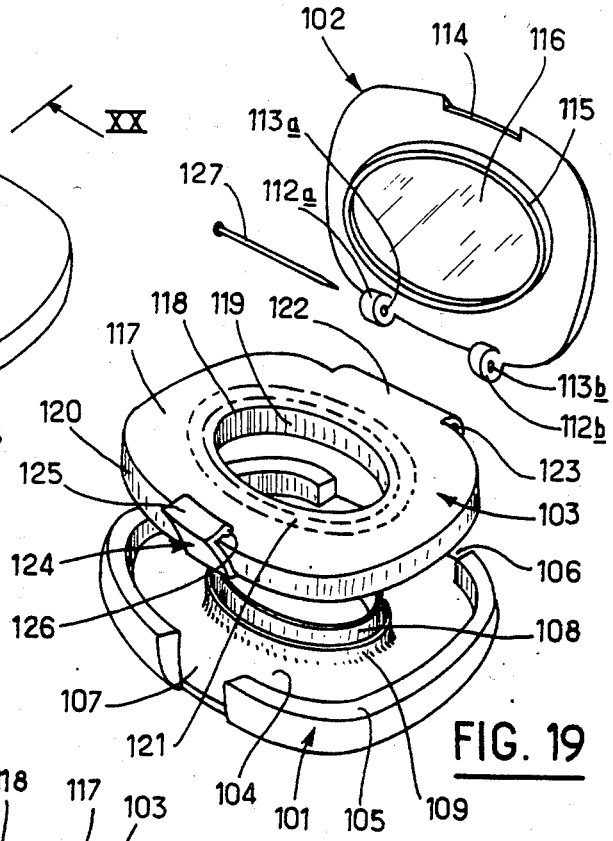
Figure 20:
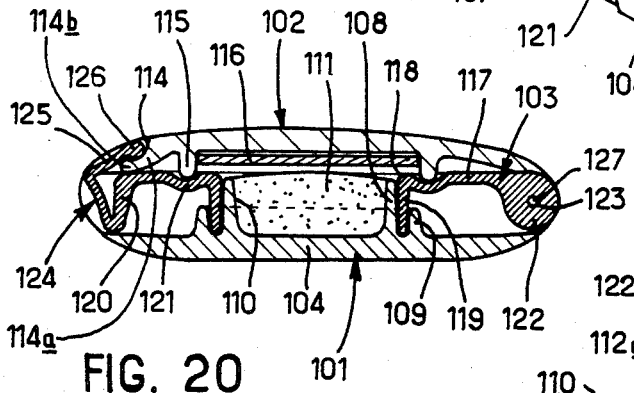

FIG. 3*a* is a schematic view on an enlarged scale of a part of FIG. 3;

FIG. 4 is a partial schematic view in perspective of the member of the closing device carried by the shell of FIG. 1;

FIG. 5 is a view in perspective of a variant of the shell of FIG. 1;

FIGS. 6, 7 and 8 are views, corresponding respectively to FIGS. 1, 2 and 3 of a compact in accordance with a second embodiment of the invention;

FIG. 9 is a partial schematic and front view of the member of the closing device carried by the shell of the compact of FIGS. 6 to 8;

FIG. 10 is a view in perspective of a compact according to a third embodiment of the invention;

FIG. 11 is a view in an exploded perspective of the shell of the compact of FIG. 10;

FIGURES 12*a* and 12*b* are partial schematic and cross-sectional views of the front portion of the compact of FIG. 10, in the closed and open positions respectively;

FIG. 13 is a view in perspective of a compact according to a fourth embodiment of the invention;

FIG. 14 is a view in an exploded perspective of the compact of FIG. 13, in the open position;

FIGS. 15 and 16 are views in perspective of variants of the shells capable of being fixed in the compact of FIG. 14;

FIG. 17 is a schematic view of the rear portion of a compact whose lid is locked in the maximum open position;

FIG. 18 is a view in perspective of a compact according to a fifth embodiment of the invention in the closed position;

FIG. 19 is a view in exploded perspective of the compact of FIG. 18 in the open position;

FIG. 20 is a cross-sectional view along XX—XX of FIG. 18; and

Figure 21:
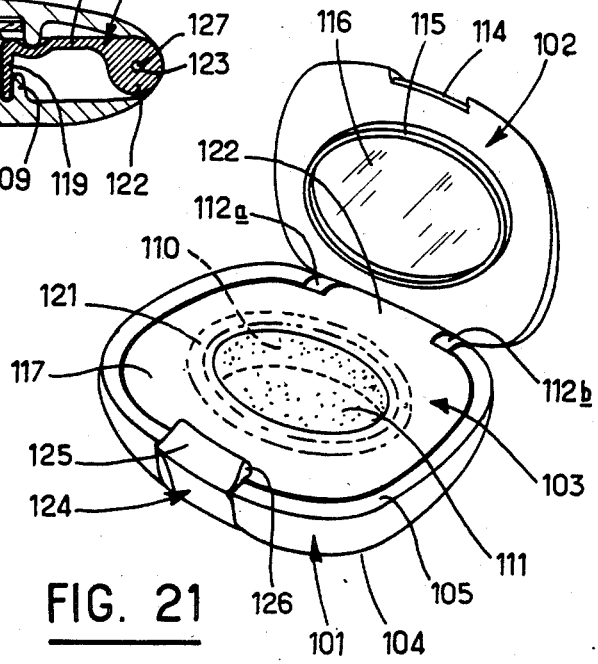

FIG. 21 is a view in perspective of the compact of FIG. 18 in the open position.

PREFERRED EMBODIMENT

The make-up compacts which are represented in the drawings are each constituted by a base, a lid and an intermediate shell. These three pieces are molded of a plastic material, the base and the lid of a relatively rigid plastic material, such as polystyrene, acrylonitrilebutadiene-styrene, styrene acrylonitrile resins (SAN), polybutylene terephthalate (PBT) or acetal resins, and the shell of a plastic material which is more flexible than the base and the lid, for instance of polypropylene, polyester, polyester block amide, polyethylene, polyurethane, a flexible polyvinyl chloride (PVC), polymers of the elastomeric types of polyesters sold under the commercial names of "HYTREL" and "ARNITEL" respectively, or a polyether block amide sold under the commercial name of "PEBAX".

The compact represented in FIGS. 1 to 4 consist of a base 1, a lid 2 and a shell 3.

Base 1 has a rim 4 surrounding a flat or slightly dome-shaped bottom 5, except along a portion of the rear edge of bottom 5 so as to define a clearance 6 and a hole 7 is arranged in the front portion of rim 4.

The lid 2 which is also flat or slightly dome-shaped, has the same shape in plan as base 1, for instance a substantially rectangular and rounded shape, and bears on the top side of rim 4 of the latter in order to close the compact. In its rear portion, lid 2 has a cylindrical part 8 projecting downwardly from its internal side and extended laterally at either end by a pin 9.

The flexible shell 3 has the shape of a frame which is mounted by elastic catch engagement in base 1 and, at its rear portion, this frame has a clearance 10 defined between two rearwardly projecting bosses 11 each such boss 11 being shaped as a hinge bearing for a pin 9 of lid 2. Each bearing 11 has substantially the form of a channel-shaped member opening towards the bottom via a passage 12 which is narrower than the diameter of pin 9 and is delimited between two flexible wings of bearing 11, this passage 12 leading into a recess 13 wherein one pin 9 of lid 2 is intended to be swivel mounted.

Lid 2 is thus articulated to shell 3 by elastic catch engagement of the pins 9 in the housings 13 of the hinge bearings 11 which are themselves elastically catch-engaged when shell 3 is fixed in base 1 by laterally outwardly projecting portions (which are not visible in the drawings), entering recesses 14 arranged in the lower portion of the lateral edges of rim 4 delimiting the clearance 6 so that the hinge constituted by the cylindrical part 8 and the pins 9 of lid 2 and by the hinge bearings 11 of shell 3, is accommodated in the clearance 6 of base 1 and is thus incorporated in the volume defined by base 1 and lid 2, without any adverse effect on the appearance of the compact and without any hole for the passing of the pin being visible from the outside.

On its front portion, shell 3 has a push button 15 projecting in a forward direction from shell 3 and engaged in the hole 7 during the mounting of shell 3 in base 1. The height of push button 15 is such that its front end projects outside the compact when the latter is closed (see FIG. 3). As has been clearly shown in FIG. 4, push button 15 is fixed to shell 3 by two flexible lateral straps 16 which join the edges of push button 15 to the edges of a clearance 17 of shell 3 wherein push button 15 is mounted in such a way that it is elastically biased by straps 16 towards the outside of base 1. The push button 15 carries, at its inner edge in base 1, a catch 18 directed towards lid 2 and towards the front and, on its central portion, a ramp 19 turned towards catch 18.

Lid 2 also has a catch 20 (FIGS. 2 and 3*a*) which is directed towards bottom 5 of base 1 and towards the inside so that in the closed position of the compact, as shown in FIGS. 3 and 3*a*, catch 20 of lid 2, which is of a complementary shape to that of catch 18 of frame 3, is locked by this catch 18 against the lower portion of ramp 19 and against the inner surface of rim 4.

To open the compact, the user exerts inwardly directed pressure on push button 15 tending to push the push button 15 into the compact. Under the effect of the elastic straps 16, and possibly by elastic deformation of the adjacent parts of the flexible frame 3, push button 15 is displaced towards the inside of the compact by sliding in hole 7. One thus obtains the release of catch 18 from catch 20 and the ramp 19 pushes back catch 20 in a direction which moves lid 2 away from base 1 and begins to open the compact. The opening of the latter is ensured by the effect of the elastic tongues 21 forming a spring and joined at one end to the line of intersection of the inner surface and the top surface of shell 3 at the level of the hinge bearings 11, the free end of the tongues 21 bearing on lid 2 which is thus strained in the opening direction.

To close the compact again, it suffices to apply lid 2 against base 1, catch 20 then coming to catch engage elastically under catch 18 of push button 15, by elastically pushing the catch 18 towards the inside and/or by pushing push button 15 towards the inside against the outward elastic restoring action ensured by the connection straps 16 to shell 3.

One thus obtains a compact provided with a closing device whose operating member obtained by moulding, that is to say push button 15 carried by shell 3, is very unobtrusive, and which allows an elastic and flexible opening of the compact, by cooperation with a preliminary opening member, that is to say the ramp 19, and spring-assisted by means of an opening member, that is to say the tongues 21. These latter simultaneously constitute a locking member for the closing device because by straining the lid 2 in the opening direction, they promote the locking of catch 20 of lid 2 behind catch 18 of the push button 15 and against the base of ramp 19 and the inner side of rim 4 of base 1. Moreover, the mechanism of the closing device as a whole is concealed within the compact. Push button 15 (with its catch 18 and its ramp 19 as well as the flexible straps 16), the elastic tongues 21, and the hinge bearings 11 are obtained by molding together with the shell 3 of a flexible and hence unbreakable plastic material such as polypropylene whilst lid 2 with its catch 20 which constitute the other member of the closing device, its cylindrical part 8 and its hinge pins 9 on the one hand, and the base 1 with the hole 7 and recesses 14 of its rim 4 on the other hand, are molded of a rigid plastic material such as polystyrene.

In the compact which has been described above, it is possible to replace the shell 3 by a variant of the embodiment, that is to say, the shell 3*a* shown in FIG. 5. Shell 3' has the same dimensions as shell 3 and also has the push button 15 with its ramp 19 and its catch 18 as well as the hinge bearings 11. However, the elastic tongues 21' obtained by molding, are no longer situated in the immediate vicinity of the hinge but are on the upper side of the lateral arms of shell 3*a* which has, moreover, a central transverse arm 22 which defines, together with bottom 5 of base 1 and with the part forming the frame of shell 3*a*, two compartments 23 and 24 wherein there may be disposed respectively an applicator brush and a pellet of compacted powder.

The compact of the second embodiment represented in FIGS. 6 to 8, is only substantially distinguished from the compact of FIGS. 1 to 4 by the design of the closing device. In this case, the latter is no longer manipulated by being pushed towards the inside of the compact but by the pivoting of the operating member downwardly.

Base 1' is solely distinguished from base 1 of the first mode of embodiment in that the hole 7 is replaced by a cut-out 7' opening out in the upper side of rim 4.

Lid 2' is solely distinguished from lid 2 of the first embodiment in that it has a cut-out 25 which can be seen in FIG. 6 and whose two lateral edges extend those of cut-out 7' of base 1' in the closed position of the compact, so as to delimit an opening accommodating the operating member 15' of the closing device. This member 15' which has the shape of a pedal is integral with the shell 3' which is, moreover, identical with that of the first mode of embodiment, by two lateral portions 16' with a reduced height (FIG. 9) which constitute an elastic hinge allowing member 15' to pivot in relation to shell 3' under the effect of a pressure vertically downwardly exerted on member 15' and with elastic biasing of the latter into the position which it occupies in FIGS. 6 to 8 when this pressure has been released. The member 15' has, projecting towards the inside of the compact, a catch 18' (FIG. 8) which is locked between a downwardly projecting catch 20' projecting under the inner side of lid 2' and directed towards the outside, and the front rim of lid 2' at the bottom of cut-out 25. Under the effect of the elastic straining actions of member 15' by parts 16' of the shell 3' and the elastic strain in the opening direction exerted on the lid 2' by the elastic tongues 21, catches 18' and 20' are locked against each other in the locked position of the compact.

The compact is opened by exerting downward pressure on the member 15' which tilts towards the front and towards the outside of the compact. Catch 18' is released from catch 20' and, at the same time, pushes the lid 2' in the opening direction so as to begin to open the compact whose complete opening is ensured by tongues 21 which are identical with those of the first mode of embodiment.

To close the compact again, it suffices to apply the lid 2' against base 1' and to catch engage catch 20' elastically under catch 18'.

The compact of the third embodiment which is represented in FIGS. 10, 11, 12*a* and 12*b* is similar to those of the first two embodiments, but it is provided with a closing device functioning by the elastic deformation of the operating member and not by the elastic displacement of the operating member in relation to the shell.

Base 31 is practically identical with base 1' of the second embodiment. Lid 32 has a catch 44 directed towards the outside and projecting under the inner side of the lid, like catch 20' of the second mode of embodiment. Shell 33 is only distinguished from shell 3*a* of FIG. 5 by the operating member 45 of the closing device carried by it. Moreover, shell 33 cooperates like shell 3*a* with lid 32 and base 31.

In this third embodiment, the operating member 45 of the closing device is an elastically deformable member, in the shape of an inverted channel section which surmounts the reduced height portion of rim 4 defining the floor of a cut-out 37 arranged in the front portion of base 31. The channel-shaped member 45 is elastically joined by the edge of its side 47 accommodated within base 31, to the front portion of shell 33, by means of two lateral portions 46 which are low in height. At the level of the junction of its inner side flange 47 and its web or base, the channel section member 45 has a bead 48 projecting towards the outside of the channel section and towards the inside of base 31, whilst along the free edge of its external side flange 49, member 45 has an outwardly facing bead 50.

In the closed position, as shown in FIG. 12*a*, the bead 48 is locked between catch 44 of lid 32 and the inner side of the front portion of the latter. To open the compact, one exerts inward pressure on bead 50 at the bottom of member 45 which is deformed as represented in FIG. 12*b* so that bead 48 is released from catch 44 and pushes back lid 32 in the opening direction which is then ensured by tongues 21'. On being released, the channel shaped member 45 elastically reassumes the shape and position represented in FIG. 12*a*. The closing of the compact is ensured by applying lid 32 against base 31 and by the elastic catch-engagement of catch 44 under bead 48.

The flexible shell 33 is mounted in base 31 either by elastic catch engagement as in the preceding examples or by ultrasonic welding.

The fourth embodiment of compact which is represented in FIGS. 13 and 14 is also distinguished from the compact previously described by the design of its closing device which comprises an operating member functioning by a squeezing action.

Base 51 of this compact is practically identical with base 1 of the first embodiment and has in particular, like the latter, a hole 7 in the front portion of rim 4. Lid 52, possibly transparent, and provided with its cylindrical portion 8 and its two hinge pins 9, has, projecting under its inner side, and in its front portion, two closing studs 70 which are substantially parallel to each other and provided at their free end with locking catches directed towards each other. The flexible shell 53 has two hinge bearings 11 which are interconnected by a portion 54 of reduced thickness and of small height of shell 53. The latter has, in its front portion, a central opening between two elastic straps 55 which are disposed substantially parallel and project towards the outside and towards the front and which end each in a ball 56. When shell 53 is being mounted in base 51, straps 55 are introduced into the passage hole 7 so that balls 56 should project from and be accessible at the front side of the compact. In the closed position of the compact, the end catches of studs 70 are locked under straps 55 which are both between the two studs 70.

To open this compact, balls 56 are squeezed together and the two straps 55 are elastically brought towards each other which releases the studs 70, lid 52 being thereupon moved away from base 51 by the two elastic tongues 21 which are identical with those of the first and second embodiments. To close the compact again, it suffices to apply lid 52 against base 51, the catches of studs 70 pushing the two elastic straps 55 back towards each other, and then locking under these latter which elastically move apart and reassume their initial position.

FIGS. 15 and 16 each represent a different form of shell 53 of this fourth embodiment; that is to say, shells 63 and 73 respectively, in the shape of a frame like the shells 3 and 3'.

In contrast to shell 53 whereon each of the elastic straps 55 is joined at its inner end to the edge of an opening on the front portion of shell 53, shell 63 does not have any opening in its front portion but an inwardly extending arc section 64 in the central portion whereof there is attached the foot of a Y shaped member which is disposed to project outwardly and whose two arms 65 form elastic straps analogous to straps 55 of the fourth embodiment; they also terminate in balls 66 and cooperate, in the same manner as straps 55, with the closing studs such as studs 70 of FIG. 14. In this case, there is no need for the hinge bearings 11 to be interconnected to each other.

Shell 73 carries straps 75 bent at right angles and fixed at their feet to shell 73 at the level of a cut-out of the front portion of the latter, and these straps 75, like arms 65 and straps 55, also pass through a hole such as 7 in the front portion of the base and cooperate in the same manner with the studs such as the studs 70 of FIG. 14.

Reference will now be made to FIG. 17: in order to limit the opening of the compact in a maximum position, at least one of pins 9 of the hinge of the lid, such as lid 2 may be fixed for rotation with a cog wheel 25, one of whose cogs 26 is of greater height than the others and may come to bear against a rearwardly projecting tooth 27 on a shell such as shell 3. Lid 2 is even held in the maximum opening position by the elastic catch engagement of cog 26 between tooth 27 and a second smaller tooth 28, which is situated below tooth 27 and is also carried by shell 3. Lid 2 is thus prevented from falling back and the hinge can have a very soft operation.

The compact in accordance with the fifth embodiment represented in FIGS. 18 to 21, comprises a base 101, a lid 102 and a flexible intermediate shell 103.

Base 101 comprises a bottom 104 having substantially the shape of a rounded rectangle and having a substantially constant thickness except at its periphery where it progressively diminishes to constitute a rounded outer edge. Bottom 104 is surrounded by a rim 105 disposed on its inner side, except along the central portion of the two large sides which constitute the back and front edges respectively of bottom 104, so as to delimit, at the back, a clearance 106 and, at the front, a passage 107, the clearance 106 being larger than passage 107.

Moreover, the bottom 104 carries on the side of rim 105, two upstanding cylindrical coaxial skirts which are perpendicular to its flat inner surface and whose common axis passes through the centre of symmetry of the bottom 104, that is to say, there is an inner skirt 108 with a height substantially equal to that of rim 105 and an outer skirt constituting a bead 109, separated from skirt 108 by a short distance and being of a smaller height than the latter. Skirt 108 and bottom 104 together delimit a dish 110 intended to accommodate make-up 111 (FIG. 20).

Lid 102 is constituted by a slightly curved plate and also having the shape of a rounded rectangle. Its dimensions are calculated in such a way that it can come to bear exactly against the upper side of rim 105 of base 101, in the closed position of the compact, with the concavity turned towards the inside of the compact.

Along its rear edge, lid 102 carries two identical hinge bearings 112*a*, 112*b*, projecting on the inner side of the said lid 102. Each bearing 112*a*, 112*b* has the shape of a cylinder whose axis is parallel to the rear edge of lid 102 and which is traversed by an axial passage 113*a*, 113*b* respectively. Moreover, the hinge bearings 112*a*, 112*b* are disposed on either side of the transverse plane of symmetry of lid 102.

On the opposite side of these bearings 112*a*, 112*b*, the front edge of lid 102 is, in its central zone, turned back towards the inside, as may be seen in particular in FIG. 20, so as to arrange, at the external edge of lid 102, a cavity 114 whose function is indicated below. This folded portion constitutes a tongue 114 whose free end forms an outer bead 114*b*.

Against the inner side of lid 102, there is disposed an endless circular bead 115 centred on the centre of symmetry of lid 102. This endless bead 115 is integral with lid 102 and it serves as an encircling element for a mirror 116 of a circular shape, fixed, for instance, by bonding against the inner side of lid 102.

The inner shell 103 is constituted by a partition 17 also having the shape of a rounded rectangle but with slightly smaller dimensions than those of the rounded rectangle delimited by the inner edge of rim 105 of base 101. This partition 117 has a central circular opening 118 and it is turned back at right angles along the edge of this opening 118 to constitute a cylindrical skirt 119. Moreover, along its external edge, the partition 117 is also turned back at right angles so as to constitute a peripheral skirt 120 situated on the same side as the central skirt 119.

In the zone of the partition 117 which surrounds opening 118, this partition 117 has an undulation constituting an endless circular gutter 121 whose concavity is turned towards the side opposite from skirts 119 and 120.

Along its rear edge, the partition 117 comprises, on the same side as the above mentioned two skirts 119,120, a hinge bearing 122 which has a cylindrical shape with an axis parallel to the rear edge of partition 117 and which is traversed by an axial passage 123.

Shell 103 has, moreover, along its front edge and in its central region, a tongue 124 obtained integrally therewith and joined to the free edge of skirt 120 by forming an acute angle with the said skirt 120. Moreover, tongue 124 is turned back to constitute a flap 125 surmounting the partition 117 of shell frame 103, the free end of this flap 125 forming moreover a catch engagement bead 126 directed towards the partition 117.

The assembly of this compact is extremely simple because it suffices to join shell frame 103 and lid 102 by disposing them side-by-side so that the hinge bearings 112*a* and 112*b* come to be situated on either side of the hinge bearing 122 of shell frame 103. A pin 127 (shown in FIG. 19) is then fitted in the axial passages 113*a*, 123 and 113*b*, and then the shell frame 103, having previously received make-up 111 in dish 110, is fixed in the base 101 such that the skirt 119 of shell frame 103 comes to be situated in the groove which is laterally delimited by skirts 108 and 109 of base 101 and whose bottom is constituted by the floor 104 of the base 101. Skirt 120 bears against the inner lateral wall of rim 105 of base 101, tongue 124 comes to be disposed in passage 107 and the hinge bearings 112*a*, 112*b* and 122 come to occupy substantially the clearance 106 of base 101.

One has thus constituted a unit of pleasing appearance whose hinge bearings 112*a*, 112*b* and 122 are incorporated in the space determined by the base 101 and lid 102 without any hole for the passage of the hinge pin being visible from the outside.

When the compact 101 is closed, the catch engagement bead 126 of tongue 124 comes to be fixed in cavity 114 of the lid 102, behind bead 114*b*. The bead 115 of this lid 102 bears against the floor of channel 121 and may moreover deform it slightly, thus ensuring a perfect seal for the dish 110.

To open the compact, it suffices to press downwardly slightly on flap 125 for disengaging bead 126 from its cavity 114. During use, mirror 116 advantageously allows a magnifying effect to be obtained on making up.

I claim:

1. A compact which is intended to enclose at least one make-up product of a solid consistency, and which comprises:

(a) first and second main elements made of a relatively rigid material, one of said main elements constituting a base of the compact and the other said main element constituting a lid of the compact;

(b) fastener means comprising at least two members having parts of complementary shape, in order to secure the two main elements to each other to keep them applied against each other in the closed position of the compact;

(c) means movably mounting at least one of said members relative to said base of the compact in order to allow the manipulation of the fastener means for actuating closing and opening of the compact;

(d) a shell frame made of a relatively flexible material being mounted in said first main element of the compact;

(e) hinge means mounting said first and second main elements of the compact for relative movement between the closed position and an open position of the compact;

(f) means defining a passage in said first main element and movably receiving one of said members of the fastener means;

(g) a resiliently deformable zone on said shell frame; and (h) means mounting the other said member of the fastener means on said lid of the compact;

wherein said means movably mounting said one member of the fastener means connects said one member to said resiliently deformable zone; said one member of the fastener means is accessible from outside the compact, in said closed position, by means of said passage arranged in said base; whereby manipulation of the said one member of the fastener means so as to actuate opening of the compact deforms said resiliently deformable zone of the shell frame so as to release the said one member from the other member of the fastener means;

said hinge means comprising first and second hinge elements, said first hinge element being carried by said shell frame and said second hinge element being carried by said second main element of the compact;

said other of said members of said fastener means including a catch extending from said lid toward said base, said one of said members including a catch member on said shell frame, said shell frame further including ramp means diposed so that upon said manipulation of said one member of said fastener means, said ramp means will engage said catch and move said catch and said lid in a direction away from said base.

2. A compact according to claim 1, wherein it comprises at least one member for opening of the compact by moving the lid away from the base when said one member of the fastener means which is carried by the shell frame is manipulated.

3. A compact according to claim 1, including at least one member carried by the shell frame for opening the compact when the fastener means is released.

4. A compact according to claim 1, including at least one member, carried by the member of the fastener means which is carried by the shell frame, for opening the compact as the fastener means is released.

5. A compact according to claim 1, including at least one member carried by the second main element of the compact, for opening the compact as the fastener means is released.

6. A compact according to claim 1, including at least one elastic member operable to lock said two members of the fastener means to each other in a fixing position while said one member of the fastener means keeps the compact closed.

7. A compact according to claim 1, including bearing means for the hinge means carried by the shell frame, and hinge pin means carried by the second main element of the compact.

8. A compact according to claim 1, including stop means carred by the shell frame and second main element of the compact for limiting the opening movement of the lid in relation to the base to a maximum angle.

9. A compact according to claim 8, wherein said stop means comprise a first cog which is integral with one of the shell frame and the second main element, and two further cogs which are integral with the other of the second main element of the compact and the shell frame, and wherein the base and the lid are able to be locked with respect to each other in the maximum opening position by the elastic catch engagement of said first cog between said further cogs.

10. A compact according to claim 1, including elastic catch engagement means for fixing the shell frame in the first main element of the compact.

11. A compact according to claim 1, wherein the shell frame is fixed in the first main element of the compact by ultrasonic welding.

12. A compact according to claim 1, wherein the shell frame constitutes an internal frame mounted in the base of the compact and delimits with the floor of this base at least one compartment in the compact.

13. A compact according to claim 1, including means defining at least one dish carried by at least one of the base and the shell frame for accommodating make-up product, and wherein the second main element cooperates with the shell frame to ensure the seal of the dish means in the closed position of the compact.

14. A compact according to claim 13, wherein said second main element of the compact internally comprises at least one endless bead which is integral with the said second main element, the said at least one endless bead being capable of bearing on the shell frame on closure of the compact and deforming a zone of the said shell frame which is situated opposite and surrounds said at least one dish.

15. A compact according to claim 14, wherein said zone of the shell frame situated opposite each bead has the shape of at least one endless channel whose concavity is turned towards said endless bead.

16. A compact according to claim 15, wherein the shell frame comprises, opposite said endless bead, a thin wall having an undulation which constitutes said at least one endless channel.

17. A compact according to claim 16, wherein the first main element of the compact is said base and the shell frame has an opening for accommodating each of the dishes, wherein each dish is delimited by the floor of the base and by an upstanding lateral skirt integrally made together with said floor; and wherein the shell frame comprises a substantially flat partition which defines said at least one channel and including means defining at least one opening for accommodating the at least one dish, the said partition being turned back on the one hand at its periphery, and on the other hand, along the edge of each said at least one opening to fix the shell frame in the base.

18. A compact according to claim 17, wherein the shell frame has a free edge delimiting each said at least one opening in the shell frame, and including groove means formed on the floor of the base to accommodate each said free edge of the shell frame.

19. A compact according to claim 18, wherein said base includes a respective skirt constituting the lateral wall of a said dish and a respective bead which is coaxial with the said skirt and made integrally with the floor of the said base, and wherein said groove means of the base is delimited between said skirt and bead around each said dish.

20. A compact according to claim 13, wherein the first main element of the compact is said base, and the shell frame has an opening for accommodating each of the dishes, wherein each dish is delimited by the floor of the base and by an upstanding lateral skirt integrally made together with said floor.

21. A compact according to claim 1, wherein the lid of the compact and the shell frame are components molded of a plastics material, and wherein said one member of the fastener means carried by the shell frame is integrally molded therewith.

22. A compact according to claim 21, wherein said hinge means comprises first and second hinge elements, said first hinge element being carried by the shell frame and said second hinge element being carried by said second main element of the compact; wherein said hinge means includes bearing means for the hinge means carried by the shell frame, and hinge pin means carried by the second main element of the compact; and wherein each of the elements of the hinge means is obtained by molding together with the molded piece which carries it.

23. A compact according to claim 1, wherein said one member of the fastener means which is carried by the shell frame is an elastically deformable member with a substantially channel-shaped cross-section comprising two side flanges formed by a central web, wherein said channel section member surmounts a part of the periphery of the first main element of the compact and is elastically joined to the shell frame by its side flange accommodated within the compact, said channel section deformable member having on its other side flange a projecting portion, and said second main element of the compact having an integral catch which catch engages elastically behind said projecting portion of the channel section member so that an inwardly directed push on the side flange of the channel-shaped member which is outside the compact, produces a deformation of the channel-shaped member whose said projecting part is released from said catch of the second main element of the compact.

24. A compact according to claim 23, wherein said projecting part of the deformable member constitutes a member for opening of the compact as the fastener means is released.

25. A compact according to claim 23, including a pair of elastic tongues each joined at an end to the shell frame in the portion of the shell frame which is near the hinge of the compact and on the side of the shell frame which faces the second main element of the compact, said second main element of the compact being pushed away from the first main element by the other end of the tongues for opening the compact.

26. A compact according to claim 1, wherein said second main element of the compact includes an integral catch; and wherein said one member of the fastener means which is carried by the shell frame is a push button having a catch and engaged in said passage of the first main element of the compact and elastically joined to the shell frame and is biased into a position locking said catch of the push button behind said catch which is integral with the second main element of the compact, so that a pressure exerted on the push button releases the said two catches from each other and allows the compact to be opened.

27. A compact according to claim 26, wherein the push button is mounted to slide substantially in said passage of the first main element of the compact and is elastically biased towards the outside of the compact by at least one flexible strap connecting it to the shell frame, and wherein release of the catches is obtained by an inwardly directed push tending to push the push button into the compact.

28. A compact according to claim 27, and including a ramp carried by the push button and pushing back said catch which is integral with the second main element of the compact, thus moving the second main element away from the first main element of the compact when the push button is pushed towards the inside of the compact.

29. A compact according to claim 26, wherein the push button is substantially pivotally mounted in said passage of the first main element of the compact and is elastically biased into the position in which it locks the catches by means of an elastic hinge for connecting the push button to the shell frame, the catches being released by a push directed transversely in relation to the compact and tending to bend the push button around the hinge.

30. A compact according to claim 1, wherein said one member of the fastener means which has at least one movable part, is constituted by an external tongue joined to the shell frame and said tongue is turned back to constitute a flap surmounting the free side of the said shell frame; wherein said second main element of the compact has an edge corresponding to said free side of the shell frame, said corresponding edge including a cavity; and wherein said flap is capable of being fixed by elastic catch-engagement in said cavity along said corresponding edge of the second main element.

31. A compact according to claim 1, wherein the first main element is the base and wherein at least one bead of the lid surrounds a mirror disposed against the said lid.

32. A compact according to claim 31, wherein the base of the compact defines a dish, and wherein on closure of the compact the bead of the lid which surrounds said mirror seals the dish which is opposite the mirror.

* * * * *